US005979571A

United States Patent [19]

Scott et al.

[11] Patent Number: 5,979,571

[45] Date of Patent: Nov. 9, 1999

[54] COMBINATION MILLING TOOL AND DRILL BIT

[75] Inventors: Danny Eugene Scott, Montgomery; Jack Thomas Oldham, Willis; Gerald D. Lynde, Houston; Greg Nazzal, Kingwood; Roy E. Swanson, Sugarland; Brad Randall, The Woodlands; James W. Anderson, Cypress, all of Tex.

[73] Assignee: Baker Hughes Incorporated, Houston, Tex.

[21] Appl. No.: 08/936,056

[22] Filed: Sep. 23, 1997

Related U.S. Application Data

[60] Provisional application No. 60/027,386, Sep. 27, 1996.

[51] Int. Cl.[6] ..... E21B 7/04; E21B 29/06; E21B 10/46

[52] U.S. Cl. ..... 175/61; 166/50; 166/298; 175/426; 175/431

[58] Field of Search ..... 175/426, 428, 175/431, 434, 425, 379, 374, 307, 61, 80, 81, 82; 166/298, 55.1, 50

[56] References Cited

U.S. PATENT DOCUMENTS

| | | | |
|---|---|---|---|
| 2,819,043 | 1/1958 | Henderson | 255/61 |
| 3,066,749 | 12/1962 | Hildebrandt | 175/317 |
| 3,765,493 | 10/1973 | Rosar et al. | 175/319 |
| 3,908,759 | 9/1975 | Cagle et al. | 166/117.6 |
| 4,255,165 | 3/1981 | Dennis et al. | 51/309 |
| 4,690,228 | 9/1987 | Voelz et al. | 175/24 |
| 5,025,873 | 6/1991 | Cerkovnik | 175/329 |
| 5,025,874 | 6/1991 | Barr et al. | 175/329 |
| 5,027,912 | 7/1991 | Juergens | 175/329 |
| 5,135,061 | 8/1992 | Newton, Jr. | 175/428 |
| 5,248,006 | 9/1993 | Scott et al. | 175/420.2 |
| 5,423,387 | 6/1995 | Lynde | 175/61 |
| 5,531,281 | 7/1996 | Murdock | 175/431 |
| 5,887,655 | 3/1999 | Haugen et al. | 166/298 |
| 5,887,668 | 3/1999 | Haugen et al. | 175/79 |

FOREIGN PATENT DOCUMENTS

| | | |
|---|---|---|
| 2 086 451 | 5/1982 | United Kingdom . |

*Primary Examiner*—Hoang C. Dang
*Attorney, Agent, or Firm*—Gerald W. Spinks

[57] ABSTRACT

A combination metal milling and earth drilling tool, for use in performing a single trip kickoff from a casing in a well bore. The combination milling and drilling tool has a first, relatively more durable cutting structure, such as tungsten carbide, and a second, relatively harder cutting structure, such as polycrystalline diamond. The more durable first cutting structure is better suited for milling metal casing, while the harder second cutting structure is better suited for drilling through a subterranean formation, especially a rock formation. The first cutting structure is positioned outwardly relative to the second cutting structure, so that the first cutting structure will mill through the metal casing while shielding the second cutting structure from contact with the casing. The first cutting structure can wear away while milling through the casing and upon initial contact with the rock formation, thereby exposing the second cutting structure to contact with the rock formation. The second cutting structure can then be used to drill through the rock formation.

18 Claims, 4 Drawing Sheets

COMBINATION MILLING TOOL AND DRILL BIT

CROSS REFERENCE TO RELATED APPLICATIONS

This application relies upon the priority of co-pending U.S. Provisional Patent Application Ser. No. 60/027,386, filed on Sep. 27, 1996, and entitled "Combination Milling Tool and Drill Bit."

FEDERALLY SPONSORED RESEARCH OR DEVELOPMENT

Not Applicable

BACKGROUND OF THE INVENTION

The present invention is in the field of tools used for drilling oil and gas wells. Specifically, this invention applies to the drilling of a new well bore which branches off from an existing well bore which has been drilled and cased.

It very often occurs that after a well bore has been drilled and the casing installed, a need arises to drill a new well bore off to the side, or at an angle, from the original well bore. The new well bore may be a lateral bore extending outwardly from the original vertical well bore. The process of starting a new well bore from the existing bore is often called "kicking off" from the original bore. Kicking off from an existing well bore in which metal casing has been installed requires that the casing first be penetrated at the desired depth.

Typically, a section mill or window mill is used to penetrate the metal casing, then the window mill and the drill string are withdrawn from the well bore. Following the milling of the window, a drill bit is mounted on the drill string, run back into the well, and used to drill the lateral well bore. Tripping in and out of the well bore delays the drilling process and makes the well more expensive to complete. The reason for using two different tools in spite of this is that the window mill must penetrate the metal casing, while the drill bit must penetrate the subterranean formation, which often contains highly abrasive constituents.

Milling of metal requires a cutting structure, such as a cutting insert, which is formed of a material hard enough to cut the metal but durable enough to avoid excessive breakage or chemical deterioration of the insert. If the insert crumbles or deteriorates excessively, the insert will lose the sharp leading edge which is considered most desirable for the effective milling of metal. Both hardness and durability are important. It has been found that a material such as tungsten carbide is sufficiently hard to mill typical casing steel, while it is structurally durable and chemically resistant to exposure to the casing steel, allowing the insert to wear away gradually rather than crumbling, maintaining its sharp leading edge.

Drilling through a rock formation requires a cutting structure which is formed of a material as hard as possible, to allow the insert to gouge or scrape chunks out of the rock without excessive wear or abrasion of the insert. This permits the drilling operator to drill greater lengths of bore hole with a single drill bit, limiting the number of trips into and out of the well. It has been found that a material such as polycrystalline diamond is an excellent choice for drilling through a rock formation, because of its extreme hardness and abrasion resistance.

Tungsten carbide is not as good for drilling through a rock formation as polycrystalline diamond, because the diamond is harder and will therefore last longer, limiting the number of trips required. Polycrystalline diamond is not as good for milling through metal casing as tungsten carbide, because the diamond is not as structurally durable, allowing it to crumble more readily and destroy the sharp leading edge. Further, polycrystalline diamond has a tendency to deteriorate through a chemical reaction with the casing steel. There is a chemical reaction between the iron in the casing and the diamond body, which occurs when steel is machined with a diamond insert. As a result of this chemical reaction, the carbon in the diamond turns to graphite, and the cutting edge of the diamond body deteriorates rapidly. This prevents the effective machining of the steel casing with diamond. Therefore, tungsten carbide is the better choice for milling through the metal casing, and polycrystalline diamond is the better choice for drilling through the rock formation.

Unfortunately, use of each type of cutting insert in its best application requires that a first tool be used to kickoff from the original bore, and a second tool be used to drill the new bore, after kickoff. This means that two trips are required for the kickoff and drilling operation. It would be very desirable to be able to perform a single trip kickoff and drilling operation, thereby eliminating at least one trip into and out of the bore hole.

BRIEF SUMMARY OF THE INVENTION

The present invention is a combination milling and drilling tool for use in performing a single trip kickoff and drilling operation. The tool has a first type of cutting structure suitable for metal milling, for performing the kickoff operation, and a second type of cutting structure suitable for rock drilling, for drilling through the subterranean formation, subsequent to kickoff. The first and second types of cutting structures are positioned relative to each other on the tool so that only the first type of cutting structure contacts the metal casing during the milling operation, after which the second type of cutting structure is exposed to contact with the subterranean formation during the drilling operation. The first type of cutting structure can be formed of a relatively more durable material than the second type of cutting structure, because it will need to maintain its sharp leading edge during metal milling. The second type of cutting structure can be formed of a relatively harder material than the first type of cutting structure, because it will need to resist wear and abrasion during rock drilling. The first type of cutting structure can be formed of tungsten carbide, $Al_2O_3$, TiC, TiCN, or TiN, or another material hard enough to mill casing steel but relatively durable and chemically nonreactive with the steel. The second type of cutting structure can be formed of polycrystalline diamond or another material of similar hardness to facilitate drilling through a rock formation.

Two different general schemes can be used to position the first type of cutting structure relative to the second type of cutting structure so as to protect the second type of cutting structure from contact with the steel casing during milling. Each type of positioning scheme can have several different embodiments. The first type of scheme is to use two different types of cutting inserts, with one type being made of a relatively more durable material, such as tungsten carbide, and with the other type being made of a relatively harder material, such as polycrystalline diamond. The more durable inserts are placed on the tool so that they extend farther outwardly than the harder inserts, such as by placing a row of harder inserts behind a row of more durable inserts. The expression "farther outwardly" is used here to mean farther toward the outermost extremity of the tool, in a given direction. It may mean "lowermost" on the lower end of the tool, or "radially outermost" on the sides of the tool. On the bottom end of the tool, for example, a row of the more durable inserts would be placed lowermost, with a row of the harder inserts positioned just above. The size and placement of the more durable inserts are designed to allow these inserts to wear away completely at the approximate time that the casing has been penetrated. This exposes the harder inserts to contact with the rock formation for drilling.

This relative placement of the two types of inserts can be achieved by their relative placement on a given blade of the tool, with appropriate row placement as described above. Alternatively, the more durable type of insert can be placed on a first blade and the harder type of insert can be placed on a second blade. Then, the two blades can be positioned on the tool so that the first blade extends farther, downwardly or radially outwardly or both, than the second blade.

A second type of scheme for relative positioning of the two types of cutting structures involves the use of composite cutting inserts. Each such insert is formed as a composite of several different types of materials, with at least one more durable material being used to shield the less durable but harder material. This can be done in several ways. A cylindrical insert can have a solid inner core of polycrystalline diamond and an outer layer around its periphery of tungsten carbide. Alternatively, a cylindrical tungsten carbide insert can have a button or pocket of polycrystalline diamond embedded in one face. In yet another alternative, a polycrystalline diamond insert can be coated with one or more durable coatings, such as $Al_2O_3$, TiC, TiCN, or TiN. The composite inserts are then placed on the blades of the tool. The outer layer or coating of more durable material is designed to wear away as the milling operation is completed, exposing the inner body of harder material to the rock formation.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
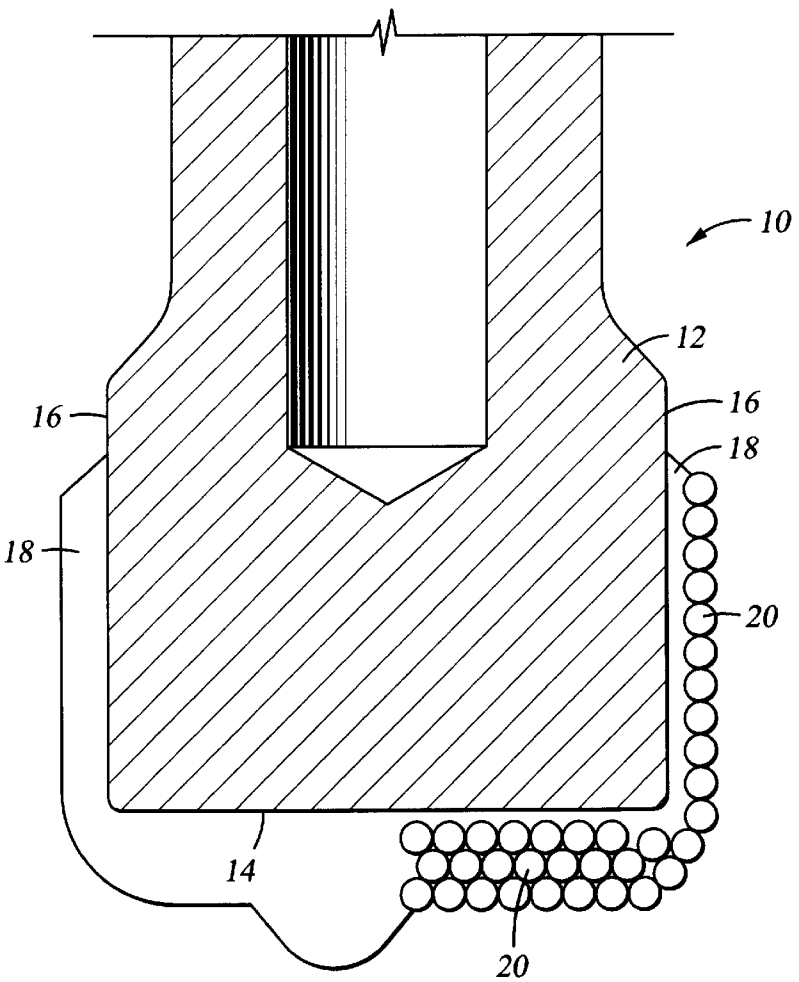
FIG. 1 is a section view of one embodiment of the combination milling and drilling tool according to the present invention.

As shown in FIG. 1, the tool 10 of the present invention has a generally cylindrical body 12, with a lower end 14 and a periphery 16. One or more blades 18 are mounted to the lower end 14 and the periphery 16 of the tool body 12. The configuration of the tool 10 is not limited to the tool shown here; other configurations could be adapted as well.

Figure 2:
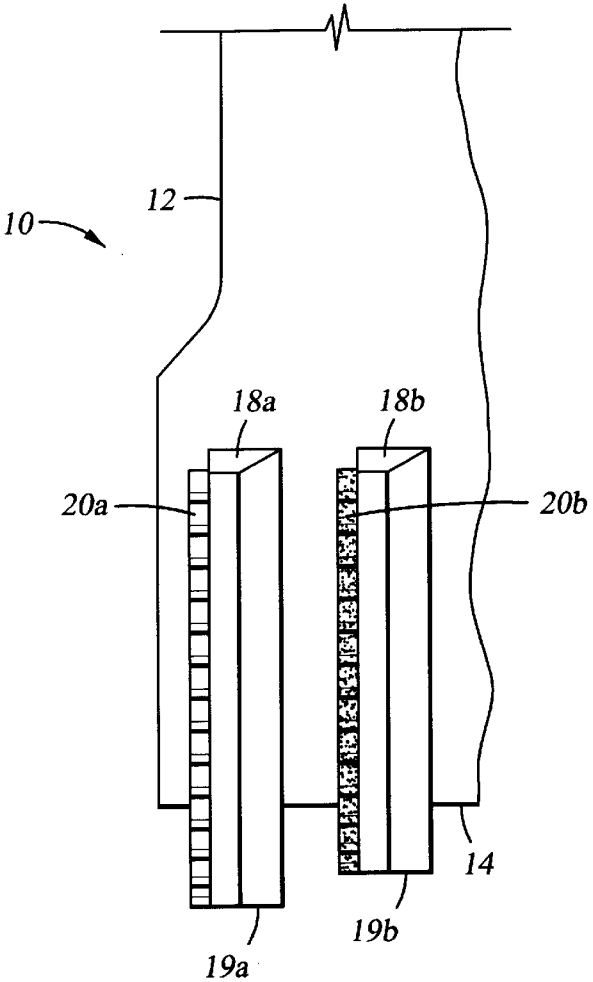
FIG. 2 is a side elevation view of the tool shown in FIG. 1.

One or more cutting structures in the form of cutting inserts 20 are affixed to a plurality of the blades 18, such as by brazing or any other suitable method. The cutting inserts 20 can be of various different types, as will be explained, depending upon what type of positioning scheme is utilized to cause a relatively more durable cutting structure to contact the casing, and to cause a relatively harder cutting structure to contact the rock formation. In one type of positioning scheme, as shown in FIG. 2, a first plurality of the cutting inserts 20*a* can be formed of a relatively more durable material such as tungsten carbide, and a second plurality of the cutting inserts 20*b* can be formed of a relatively harder material such as polycrystalline diamond. The first plurality of tungsten carbide inserts 20*a* are placed on a first blade 18*a*, while the second plurality of polycrystalline diamond inserts 20*b* are placed on a second blade 18*b*. The lowermost extremity 19*a* of the first blade 18*a* extends below the lowermost extremity 19*b* of the second blade 18*b*. Similarly, the outer periphery of the first blade 18*a* extends radially outwardly farther than the outer periphery of the second blade 18*b*. When the tool 10 of this embodiment is rotated within a metal casing, the tungsten carbide inserts 20*a* will contact the casing in a milling operation, while the diamond inserts 20*b* will not contact the casing. The tool also could be built to allow the second blade 18*b* to have slight or incidental contact with the casing, without appreciable force being applied, thereby preventing cutting contact between the diamond inserts 20*b* and the casing. As will be shown in later embodiments, the tungsten carbide also could be formed actually around the diamond to physically shield the diamond from contact with the casing. All of these approaches fall within the spirit of the invention. In the embodiment shown, the first blade 18*a* is designed to extend farther outwardly than the second blade 18*b* to the appropriate extent to allow the first blade 18*a* to penetrate the metal casing at about the time it has worn away sufficiently that the second blade 18*b* contacts the surrounding formation.

Figure 4:
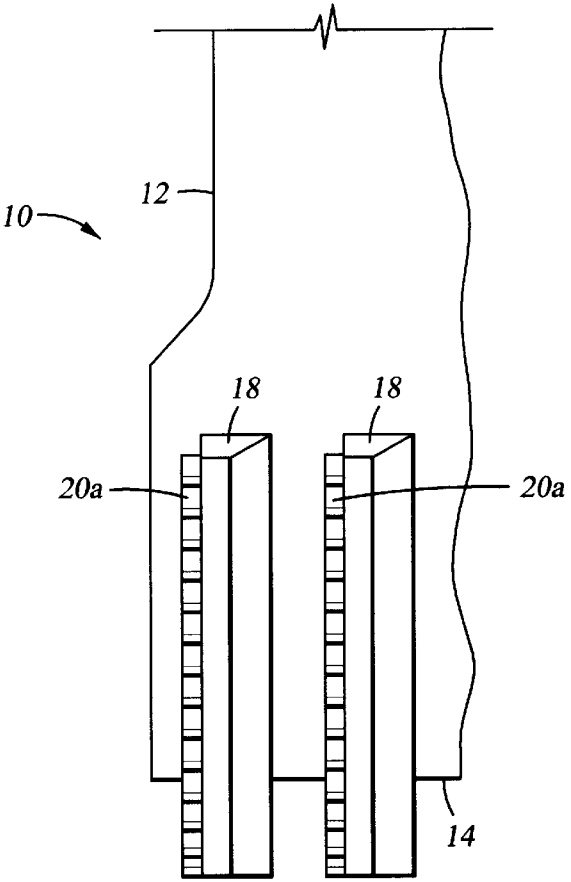
FIG. 4 is a side elevation view of the tool shown in FIG. 3.
Figure 3:
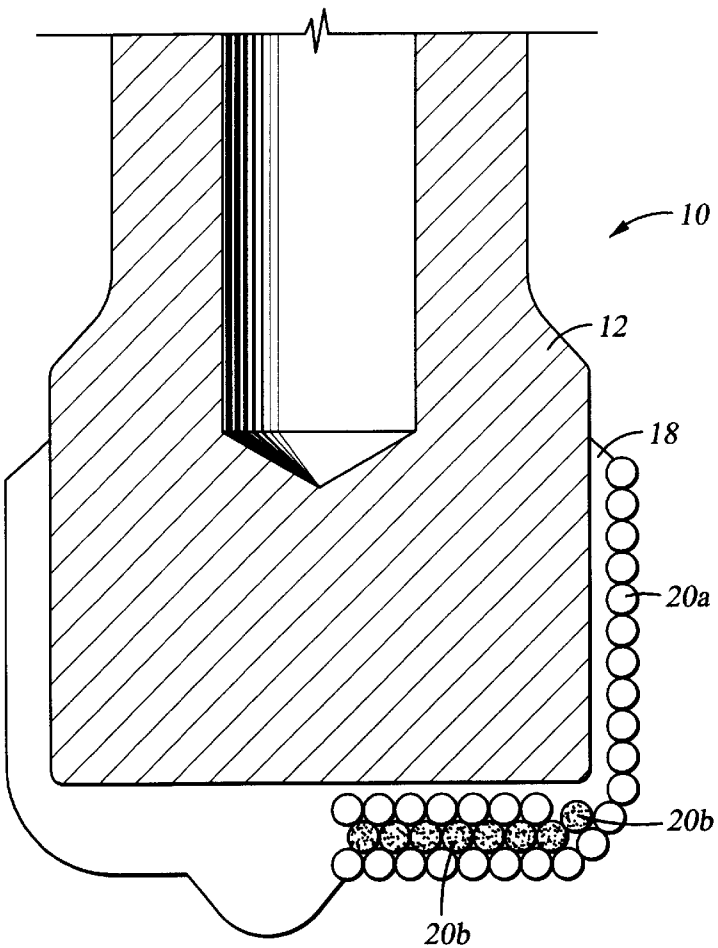
FIG. 3 is a section view of a second embodiment of the tool according to the present invention.

FIGS. 3 and 4 show another embodiment of the tool 10 which employs this same type of positioning scheme, but in a different way. In this embodiment, each blade 18 carries a first, outermost, row of tungsten carbide inserts 20*a*, and a second, inner row of diamond inserts 20*b*. A third row of inserts can also be added as shown. This embodiment of this type of positioning scheme can also utilize other placement patterns, incorporating for instance gage cutting inserts, or incorporating a wider spacing of inserts. The key element is that the tungsten carbide inserts 20*a* are positioned so as to mill through the metal casing while protecting the diamond inserts 20*b* from contact with the casing. At approximately the time that the casing has been penetrated, the row of tungsten carbide inserts are designed to wear away sufficiently to allow the diamond inserts 20*b* to contact the rock formation. In this embodiment, each blade 18 extends downwardly and outwardly to the same extent as the other blades 18, since each blade 18 has an outermost row of tungsten carbide inserts 20*a* and an inner row of diamond inserts 20*b*.

Figure 5:
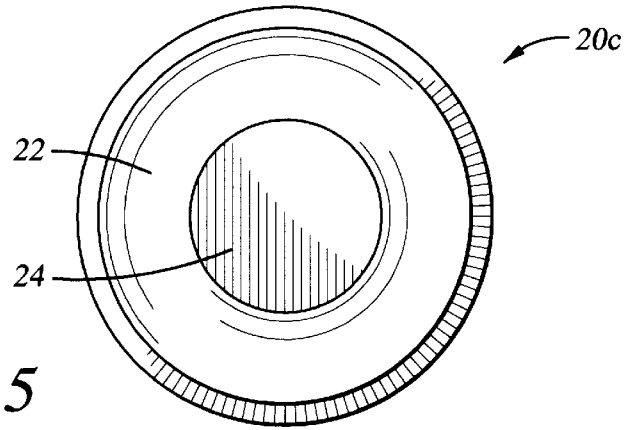
FIG. 5 is a plan view of one embodiment of a composite cutting insert for use in a tool according to the present invention.
Figure 6:
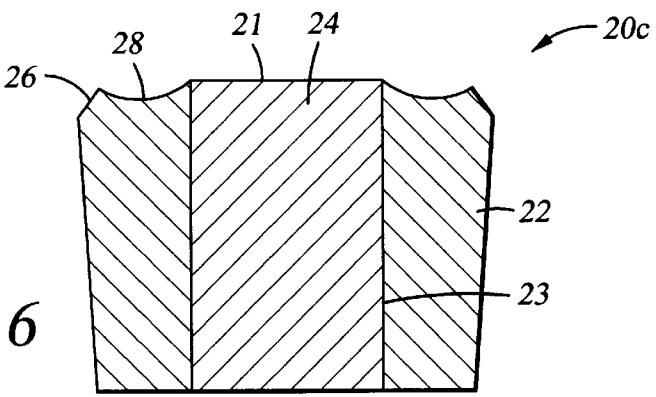
FIG. 6 is a section view of the insert shown in FIG. 5.

In a second type of positioning scheme, at least some of the cutting inserts 20 can be composite inserts which are identical to each other, with each blade 18 having the inserts 20 mounted thereon, as shown in FIG. 1. However, in this second type of positioning scheme, the relative positioning of the two types of cutting structures is accomplished by using composite inserts such as the embodiment shown in FIGS. 5 and 6. A cutting insert 20*c* is formed as a composite of two materials, with one material being relatively harder, and the other material being relatively more durable. A substantially cylindrical inner body 24 of polycrystalline diamond has at least one exposed end 21, with an outer layer 22 of tungsten carbide formed around its periphery 23. The exposed end of the outer layer 22 has a chamfered edge 26 and a chip breaking annular groove 28. This edge 26 and the chip breaking groove 28 contact the metal casing during the milling operation, to cut short, thick chips from the casing. This allows the metal chips to be removed from the well bore by circulation of the drilling fluid without birdnesting and clogging the hole. At approximately the time that the metal casing has been penetrated, the outer layer 22 is designed to wear away sufficiently to allow the inner body 24 to contact the rock formation for drilling purposes.

Figure 7:
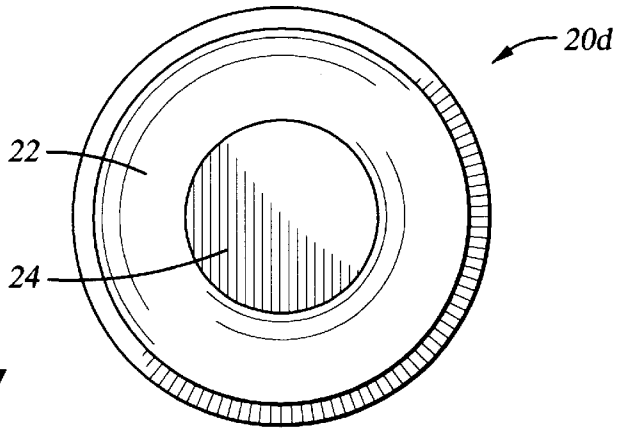
FIG. 7 is a plan view of a second embodiment of a composite cutting insert for use in a tool according to the present invention.
Figure 8:
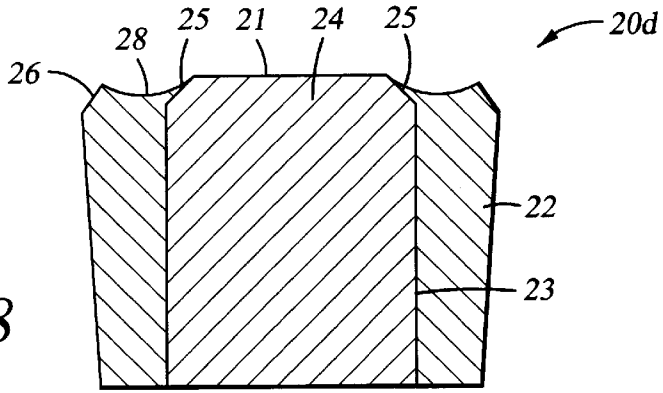
FIG. 8 is a section view of the insert shown in FIG. 7.

A second embodiment of a composite insert 20*d* which can be used in this second type of positioning scheme is shown in FIGS. 7 and 8. Here, an outer tungsten carbide layer 22 surrounds the periphery 23 of the inner diamond body 24 as discussed before. In this embodiment, however, the inner body 24 is formed with a chamfered edge 25 around its exposed upper end 21, giving the diamond inner 24 body increased durability as penetration of the metal casing is completed and the drilling of the rock formation begins. The outer layer 22 has a chamfered edge 26 and a chip breaking groove 28 as before.

Figure 9:
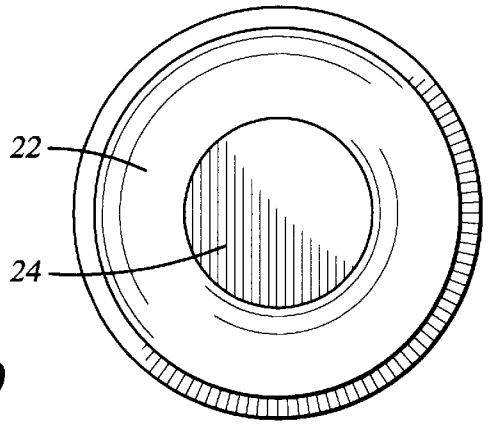
FIG. 9 is a plan view of a third embodiment of a composite cutting insert for use in a tool according to the present invention.
Figure 10:
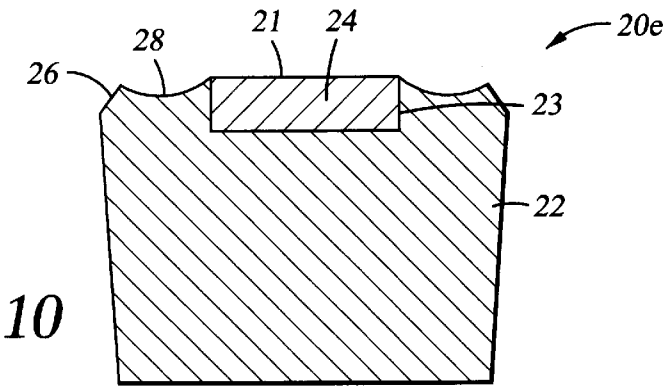
FIG. 10 is a section view of the insert shown in FIG. 9.

A third embodiment of a composite insert 20*e* which can be used in this second type of positioning scheme is shown in FIGS. 9 and 10. In this embodiment, a cup shaped outer tungsten carbide layer 22 is formed around the periphery and one end of a polycrystalline diamond button shaped inner body 24. Here again, the outer layer 22 has a chamfered edge 26 and a chip breaking groove 28. Use of the cup shaped outer layer 22 provides a tungsten carbide lower end 29 on the insert 20*e,* which can facilitate brazing the insert 20*e* to a blade 18.

Figure 11:
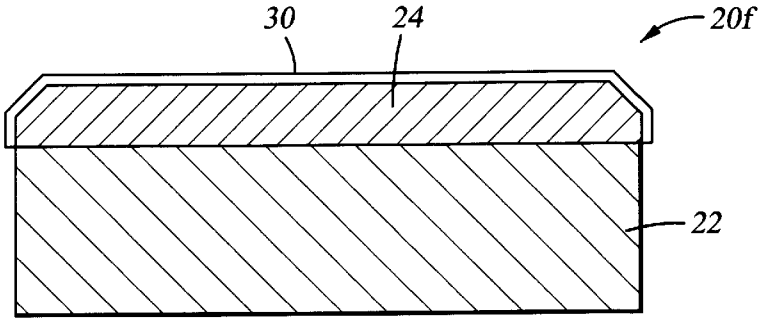
FIG. 11 is a section view of a fourth embodiment of a composite cutting insert for use in a tool according to the present invention.
Figure 12:
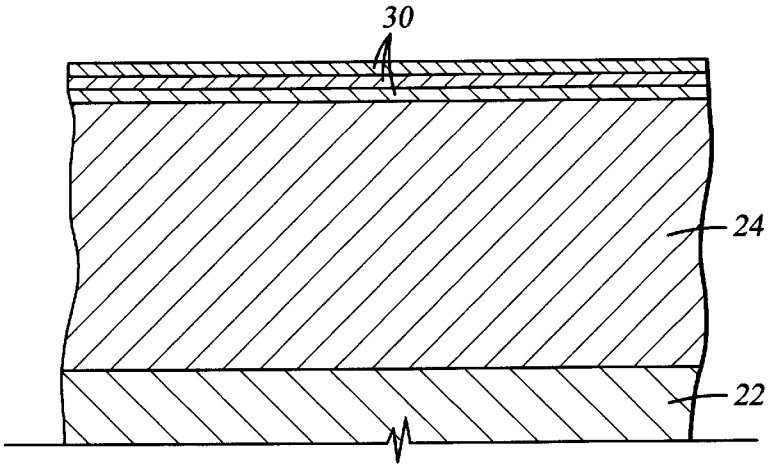
FIG. 12 is an enlarged section view of a portion of the insert shown in FIG. 11.

A fourth embodiment of a composite insert 20*f* which can be used in this second type of positioning scheme is shown in FIGS. 11 and 12. In this embodiment, a polycrystalline diamond body 24 is mounted to a tungsten carbide substrate 22, with a thin, durable coating 30 deposited over the diamond body 24. The primary purpose of using the coating embodiment is to place a chemically resistant coating over the diamond body. This prevents the normal chemical reaction between the iron in the casing and the diamond body, which occurs when steel is machined with a diamond insert. As a result of this chemical reaction, the carbon in the diamond turns to graphite, and the cutting edge of the diamond body deteriorates rapidly. This prevents the effective machining of the steel casing with diamond. The coating 30 can be deposited in several layers to facilitate adherence to the diamond body 24. The process of depositing these layers 30 can be physical vapor deposition (PVD) or chemical vapor deposition (CVD), with PVD being preferred. Or, a tungsten carbide coating can be applied in a high temperature, high pressure (HTHP) apparatus. Examples of materials which could be used in the PVD or CVD processes are $Al_2O_3$, TiC, TiCN, or TiN. Combinations of the PVD, CVD, and HTHP processes could also be used, to create a "sandwich" of durable, chemical resistant coatings. The coating protects the diamond during the milling process, but it wears away rapidly upon exposure to the rock formation.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A combination milling and drilling tool for kicking off from an existing casing in a well bore, comprising:

a tool body mountable on a drill string suspended within a casing in a well bore;

a first cutting structure mounted to said tool body, said first cutting structure being a metal milling structure constructed of a material having properties of shape, hardness, and durability designed for milling through a metal casing; and a second cutting structure mounted to said tool body, said second cutting structure being a formation drilling structure constructed of a material having properties of shape, hardness, and durability designed for drilling through a subterranean formation;

wherein, said second cutting structure is situated relative to said first cutting structure so as to minimize the occurrence of cutting contact between said second cutting structure and the metal casing, and so as to cause said second cutting structure to contact the subterranean formation after said first cutting structure has penetrated the metal casing.

2. A combination milling and drilling tool as recited in claim 1, wherein:

said first cutting structure comprises a first insert having a first level of hardness and a first level of durability;

said second cutting structure comprises a second insert having a second level of hardness and a second level of durability;

said first level of durability is greater than said second level of durability;

said second level of hardness is greater than said first level of hardness;

said first insert is positioned on said tool body so as to come into contact with the metal casing before said second insert contacts the metal casing; and said second insert is positioned on said tool body so as to come into cutting contact with the subterranean formation only after said first insert wears away during milling of the casing.

3. A combination milling and drilling tool as recited in claim 2, wherein:

said first insert is positioned on an outer extremity of said tool body so as to come into first contact with a metal casing; and said second insert is positioned inwardly on said tool body, relative to said first insert, so as to minimize contact with the metal casing.

4. A combination milling and drilling tool as recited in claim 3, wherein said first and second inserts are positioned on the same blade on said tool body, with said first insert being positioned outwardly relative to said second insert.

5. A combination milling and drilling tool as recited in claim 3, wherein:

said first insert is positioned on a first blade on said tool body;

said second insert is positioned on a second blade on said tool body; and said first blade extends outwardly farther than said second blade.

6. A combination milling and drilling tool as recited in claim 3, wherein said first insert comprises a tungsten carbide insert.

7. A combination milling and drilling tool as recited in claim 3, wherein said second insert comprises a polycrystalline diamond insert.

8. A combination milling and drilling tool as recited in claim 1, wherein:

said first cutting structure and said second cutting structure are combined in a cutting insert;

said first cutting structure comprises an outer portion of said cutting insert, said outer portion having a first level of hardness and a first level of durability;

said second cutting structure comprises an inner portion of said cutting insert, said inner portion having a second level of hardness and a second level of durability;

said first level of durability is greater than said second level of durability; and said second level of hardness is greater than said first level of hardness.

9. A combination milling and drilling tool as recited in claim 8, wherein:

said inner portion of said cutting insert comprises a solid body having a front face for cutting the subterranean formation;

said outer portion of said cutting insert comprises a layer surrounding a periphery of said solid body, shielding said solid body from contact with the metal casing, while leaving said front face exposed; and said layer wears away during milling of the casing, to leave said solid body exposed to contact with the subterranean formation.

10. A combination milling and drilling tool as recited in claim 9, wherein said outer portion comprises a tungsten carbide layer.

11. A combination milling and drilling tool as recited in claim 9, wherein said inner portion comprises a polycrystalline diamond body.

12. A combination milling and drilling tool as recited in claim 8, wherein:

said inner portion of said cutting insert comprises a solid body having a front face for cutting the subterranean formation;

said outer portion of said cutting insert comprises a coating deposited over said front face of said solid body, shielding said solid body from contact with the metal casing; and said coating is adapted to wear after milling of the casing, to leave said solid body exposed to contact with the subterranean formation.

13. A combination milling and drilling tool as recited in claim 12, wherein said outer portion comprises a coating adapted for metal cutting.

14. A combination milling and drilling tool as recited in claim 12, wherein said inner portion comprises a polycrystalline diamond body.

15. A combination milling and drilling tool as recited in claim 1, wherein said second cutting structure is situated relative to said first cutting structure so as to actually prevent cutting contact between said second cutting structure and the metal casing.

16. A method for performing a single trip kickoff from a casing in a well bore, said method comprising:

providing a combination milling and drilling tool mounted on a drill string suspended within a casing in a well bore, said tool having a first cutting structure and a second cutting structure, said first cutting structure being comparatively more durable than said second cutting structure, said second cutting structure being comparatively harder than said first cutting structure and positioned inwardly on said tool relative to said first cutting structure;

rotating said combination tool within the casing to cause said first cutting structure to mill through the casing, while said second cutting structure is shielded from contact with the casing;

exposing said second cutting structure to a subterranean formation outside the casing; and rotating said combination tool to cause said second cutting structure to drill through the subterranean formation.

17. A method as recited in claim 16, wherein:

said first and second cutting structures are combined into a composite cutting insert having a relatively more durable outer portion and a relatively harder inner portion; and said inner portion is exposed to the subterranean formation by wearing of said outer portion after milling of the casing.

18. A method as recited in claim 16, wherein:

said first cutting structure comprises a first cutting insert having a relatively more durable composition;

said second cutting structure comprises a second cutting insert having a relatively harder composition; and said second cutting insert is exposed to the subterranean formation by wearing away of said first cutting insert during milling of the casing.

* * * * *